US005518181A

United States Patent [19]

Shames et al.

[11] Patent Number: 5,518,181

[45] Date of Patent: May 21, 1996

[54] VARIABLE SPRAY OR VARIABLE PULSE SHOWER HEAD

[76] Inventors: Sidney J. Shames, 57 Holly Pl., Briarcliff Manor, N.Y. 10510; Harold Shames, 5 Anges Cir., Ardsley, N.Y. 10502

[21] Appl. No.: 245,379

[22] Filed: May 18, 1994

[51] Int. Cl.[6] ..... B05B 1/08; B05B 1/12

[52] U.S. Cl. ..... 239/381; 239/438; 239/446; 239/460

[58] Field of Search ..... 239/443–449, 239/380, 381, 99, 436–438, 456, 460; 137/867, 625.48, 625.49

[56] References Cited

U.S. PATENT DOCUMENTS

| | | | |
|---|---|---|---|
| 3,762,648 | 10/1973 | Deines et al. . | |
| 3,801,019 | 4/1974 | Trenary et al. . | |
| 3,963,179 | 6/1976 | Tomaro . | |
| 4,068,801 | 1/1978 | Leutheuser . | |
| 4,079,891 | 3/1978 | Kwan . | |
| 4,141,502 | 2/1979 | Grohe . | |
| 4,190,207 | 2/1980 | Fienhold et al. . | |
| 4,204,646 | 5/1980 | Shames et al. . | |
| 4,254,914 | 3/1981 | Shames et al. . | |
| 4,324,364 | 4/1982 | Buzzi et al. . | |
| 4,330,089 | 5/1982 | Finkbeiner | 239/447 X |
| 4,582,253 | 4/1986 | Gerdes | 239/447 X |
| 4,618,100 | 10/1986 | White et al. | 239/447 X |
| 4,785,998 | 11/1988 | Takagi | 239/446 X |
| 5,090,624 | 2/1992 | Rogers . | |
| 5,356,077 | 10/1994 | Shames et al. | 239/47 X |
| 5,588,130 | 5/1986 | Trenary et al. . | |

FOREIGN PATENT DOCUMENTS

| | | | |
|---|---|---|---|
| 3706320 | 3/1988 | Germany | 239/447 |

*Primary Examiner*—Kevin P. Weldon
*Attorney, Agent, or Firm*—Bullwinkel Partners, Ltd.

[57] ABSTRACT

A pulsating shower head that employs a rotor for effecting the discharge of a variable pulsating spray, a variable continuous spray, or a combination of both comprising an upper body housing, a rotatable lower body housing, a stationary stem housing affixed to the upper body housing, an O-ring retainer affixed to the stem housing, and a stem—rotor housing assembly that moves axially when the lower body housing is rotated. An O-ring affixed to the stem acts in conjunction with the O-ring retainer to open and close a water channel leading to a pulse chamber. At the same time, O-rings affixed to the stem housing act in conjunction with the rotor housing to open and close a water channel leading to a continuous spray chamber. Rotation of the lower body housing results in either a continuous spray, pulse spray, or combination continuous and pulse spray. The shower head may be incorporated into either a wall mounted unit or a hand held unit.

7 Claims, 5 Drawing Sheets

VARIABLE SPRAY OR VARIABLE PULSE SHOWER HEAD

BACKGROUND

1. Field of the Invention

This patent relates to a shower head from which a variable continuous spray, a variable pulsating spray, or a combination continuous and pulsating spray may be selectively discharged. More particularly, this patent relates to a shower head made of molded plastic parts and with simplified means capable of delivering a variable continuous spray, a variable pulse spray, or a combination continuous and pulse spray.

2. Description of the Related Art

Numerous shower heads are known in the art that can be adjusted to discharge a continuous spray or a pulsating spray. Typical of such shower heads are those disclosed in U.S. Pat. Nos. 3,801,019, 4,068,801, and 4,254,914. U.S. Pat. No. 3,801,019, for example, discloses a spray nozzle capable of delivering both spray and pulse, and employing three sets of flow passages. Control of the frequency of pulsation or the apportionment of spray is accomplished by adjusting a shuttered plate relative to a flow directing plate. U.S. Pat. No. 4,068,801 discloses a spray head in which the water is caused to rotate and drive a rotor. The rotor has openings that pass intermittently across jet nozzles (for pulsating spray) or perforations (for steady spray).

Our U.S. Pat. No. 4,204,646 discloses a pulsating shower head having a rotor, an upstream housing means, and a downstream housing member. The upstream housing means comprises an upstream transverse wall having concentric walls that define a rotor chamber within which the rotor can rotate. Either steady spray or pulse spray may be achieved by rotating the downstream housing member, causing it to move axially with respect to the upstream housing member. When the downstream housing member and the upstream housing member are spaced closest together, the rotor is driven, resulting in a pulse spray. When the downstream housing member and the upstream housing member are spaced farthest apart, a continuous spray is effected. At intermediate settings, both pulse and continuous sprays are achieved.

To varying degrees, such spray or pulsating shower heads utilize relatively complex and expensive constructions. Thus a need exists for a shower head capable of delivering either a variable continuous spray, a variable pulse spray, or a combination continuous and pulse spray while having a relatively simple construction that is inexpensive to produce. The present invention meets these needs, providing a simple variable pulsating shower head design with relatively few parts that can be assembled from one direction. The present invention is unique in that it employs a stem and rotor housing that move axially relative to an adjusting knob, thus causing a water stream to be diverted into either a spray chamber, a pulse chamber, or both.

SUMMARY OF THE INVENTION

It is, therefore, an object of the present invention to provide a shower head capable of delivering a variable continuous spray, a variable pulse spray, or a combination continuous and pulse spray.

A further object of the present invention is to provide a pulsating shower head of relatively simple construction that can be assembled from one direction.

Another object of the present invention is to provide a pulsating shower head that employs a stem and rotor housing that move axially relative to an adjusting knob, thus causing a water stream to be diverted into either a spray chamber, a pulse chamber, or both.

Further and additional objects will appear from the description, accompanying drawings, and appended claims.

These and other objects are achieved by a pulsating shower head comprising an upper body housing, a lower body housing, a stem housing affixed to the upper body housing, a hollow stem threadably connected to the stem housing, an O-ring retainer held in fixed relationship to the stem housing, a rotor housing held in fixed relationship to the stem, a pulse plate affixed to the rotor housing, a rotor, a spray seal, and a spray seal retainer.

The upper body housing has a cup-shaped outer wall, a downstream extending inner wall and a center stem and is configured to receive the other shower head components such that the shower head can be assembled from one direction. The lower body housing has an outer wall of approximately the same circumference as the upper body housing outer wall, and a three-tiered inner wall for receiving the stem housing, stem and rotor housing.

The stem housing is configured to fit within the lower body housing and is affixed to the upper body housing center stem by a screw or other means. The stem housing is generally cylindrical in shape and has threads disposed on the inside of the stem housing for receiving the stem. The stem housing has two circumferentially outwardly facing grooves for holding O-rings. The O-rings provide a sliding watertight seal between the stem housing and the rotor housing. A plurality of apertures interposed between the two grooves direct water flow in the continuous spray mode.

The hollow stem is threadably connected at its upstream end to the stem housing. The stem has a plurality of apertures near its upstream end for directing water flow in either the continuous spray or pulse modes. A circumferentially outwardly facing groove disposed about the stem's middle section holds an O-ring. This O-ring provides a watertight seal between the stem and the O-ring retainer in the continuous spray mode. In the pulse spray mode, the seal is open.

The rotor housing comprises a transverse wall and upstream and downstream sections extending therefrom. Vertical grooves in the rotor housing outer wall cooperate with ribs on the lower body housing such that the rotor housing is axially, but not rotatably, translatable with respect to the lower body housing. In the continuous spray mode, water is directed outside the rotor housing. In the pulse spray mode, water is directed through a plurality of tangentially directed flow channels disposed in the transverse wall and into a rotor chamber and then impinges on the rotor vanes causing the rotor to rotate.

Below the rotor is a pulse plate which has a transverse wall with a set of pulse spray apertures therethrough and a substantially cylindrical wall extending upstream from the transverse wall. Closed sections and through channels on the rotor alternately pass over the pulse spray apertures, thereby causing water pulsating action.

As noted above, the lower body housing can be rotated, but does not move vertically. The upper body housing and stem housing are held in fixed relationship, and do not move. Rotation of the lower body housing causes the stem to move vertically along the threaded inner wall of the stem housing. The rotor housing and pulse plate move vertically along with the stem. This movement causes the selective discharge of either a variable pulse spray, a variable continuous spray, or a combination of both pulse spray and jet spray.

The shower head may be incorporated into either a wall mounted unit of the type shown in FIGS. 1–3 or a hand held unit of the type shown in FIG. 4.

DETAILED DESCRIPTION OF THE INVENTION

Figure 1:
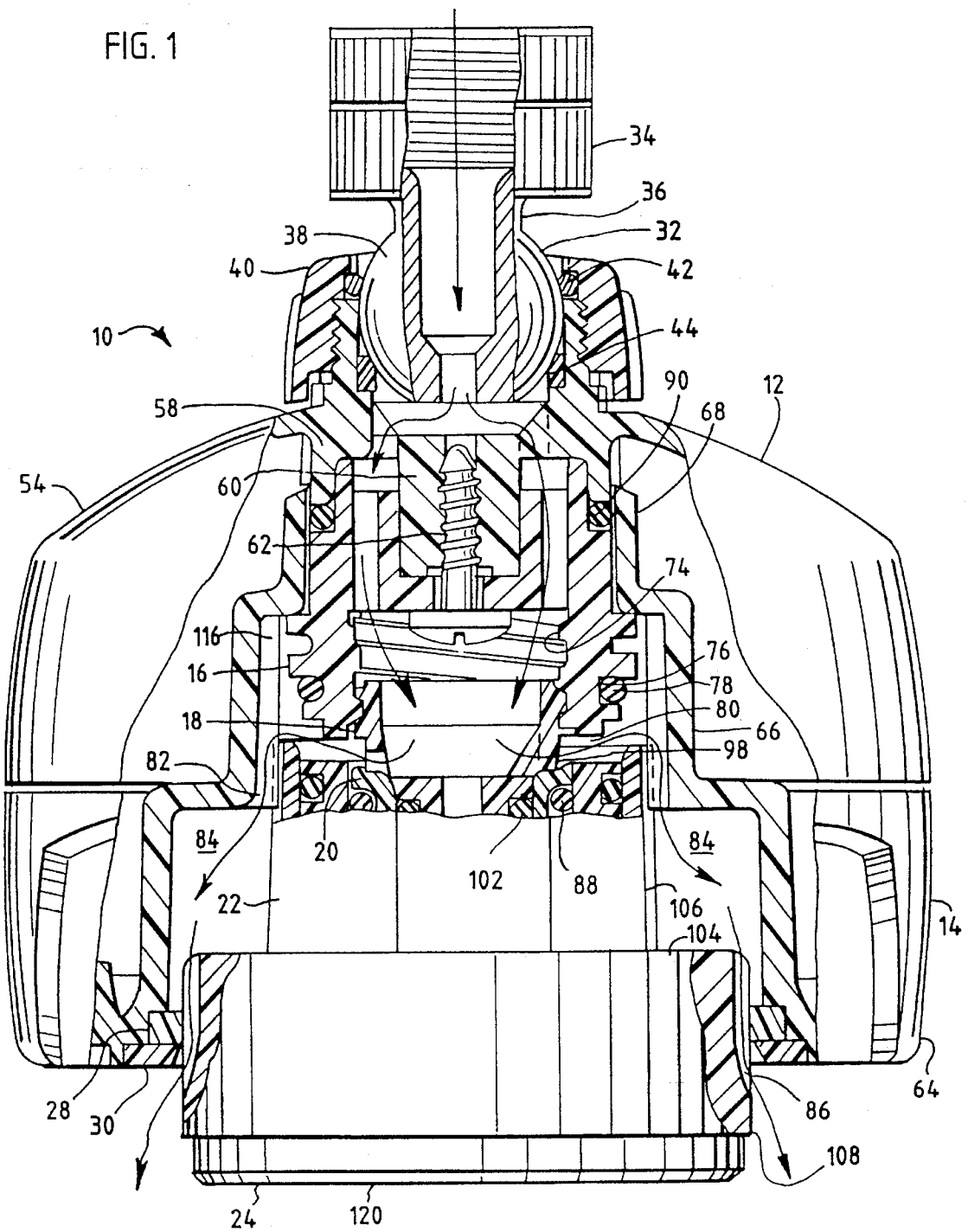
FIG. 1 is a side view of the pulsating shower head of the present invention, shown in partial cutaway, showing the shower head in the continuous spray mode.

Turning to the drawings, there is shown in FIG. 1 a partial cutaway view of the pulsating shower head 10 of the present invention, showing the shower head 10 in the continuous spray mode. The shower head 10 comprises an upper body housing 12, a lower body housing 14, a stem housing 16 affixed to the upper body housing 12, a hollow stem 18 threadably connected to the stem housing 16, an O-ring retainer 20 held in fixed relationship to the stem housing 16, a rotor housing 22 held in fixed relationship to the stem 18, a pulse plate 24 affixed to the rotor housing 22, a rotor 26, a spray seal 28, and a spray seal retainer 30.

Figure 2:
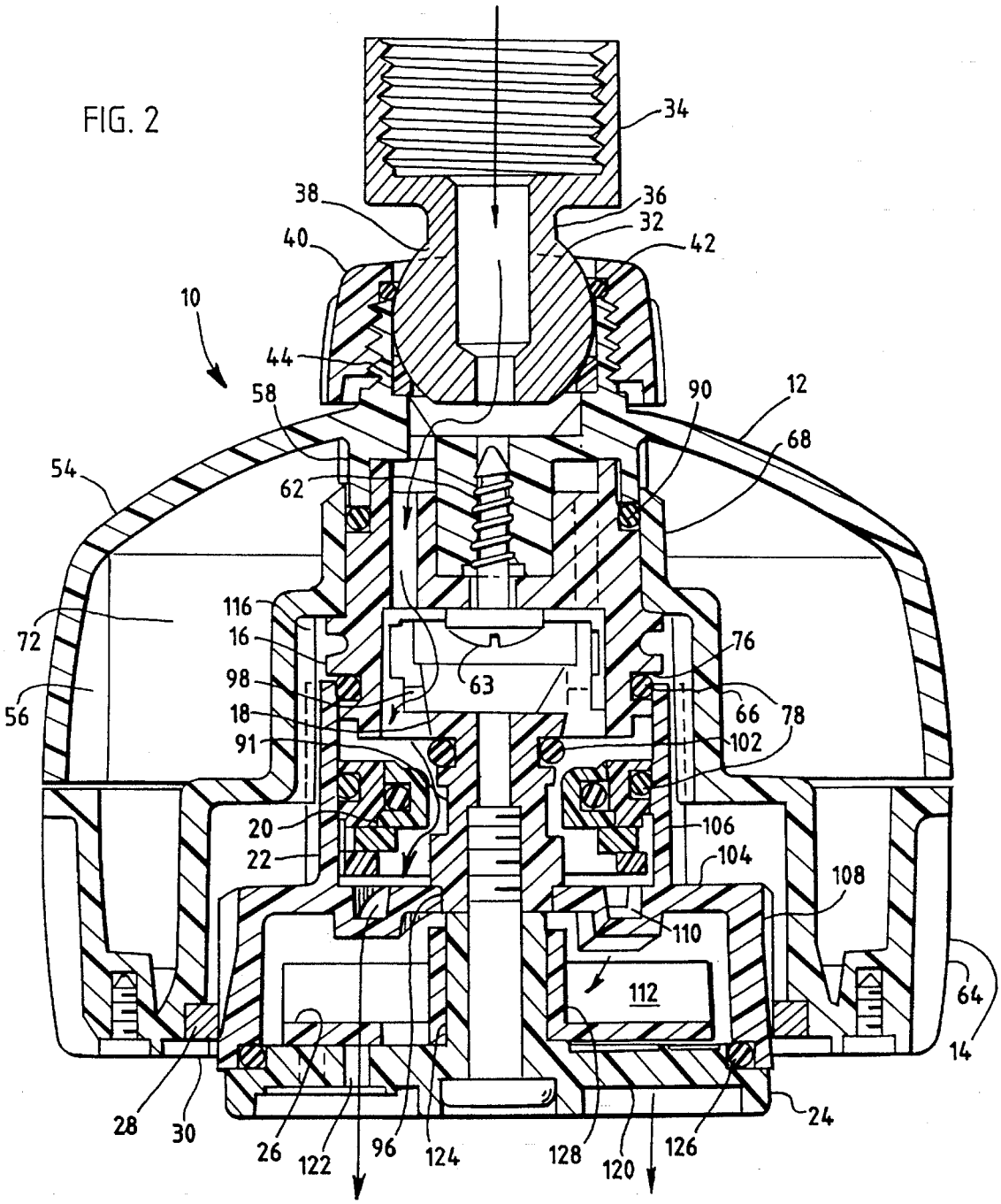
FIG. 2 is a cross-sectional view of the pulsating shower head of the present invention, the cross section being taken on a vertical plane substantially through the axis of the shower head, showing the shower head in the pulsating spray mode.
Figure 3:
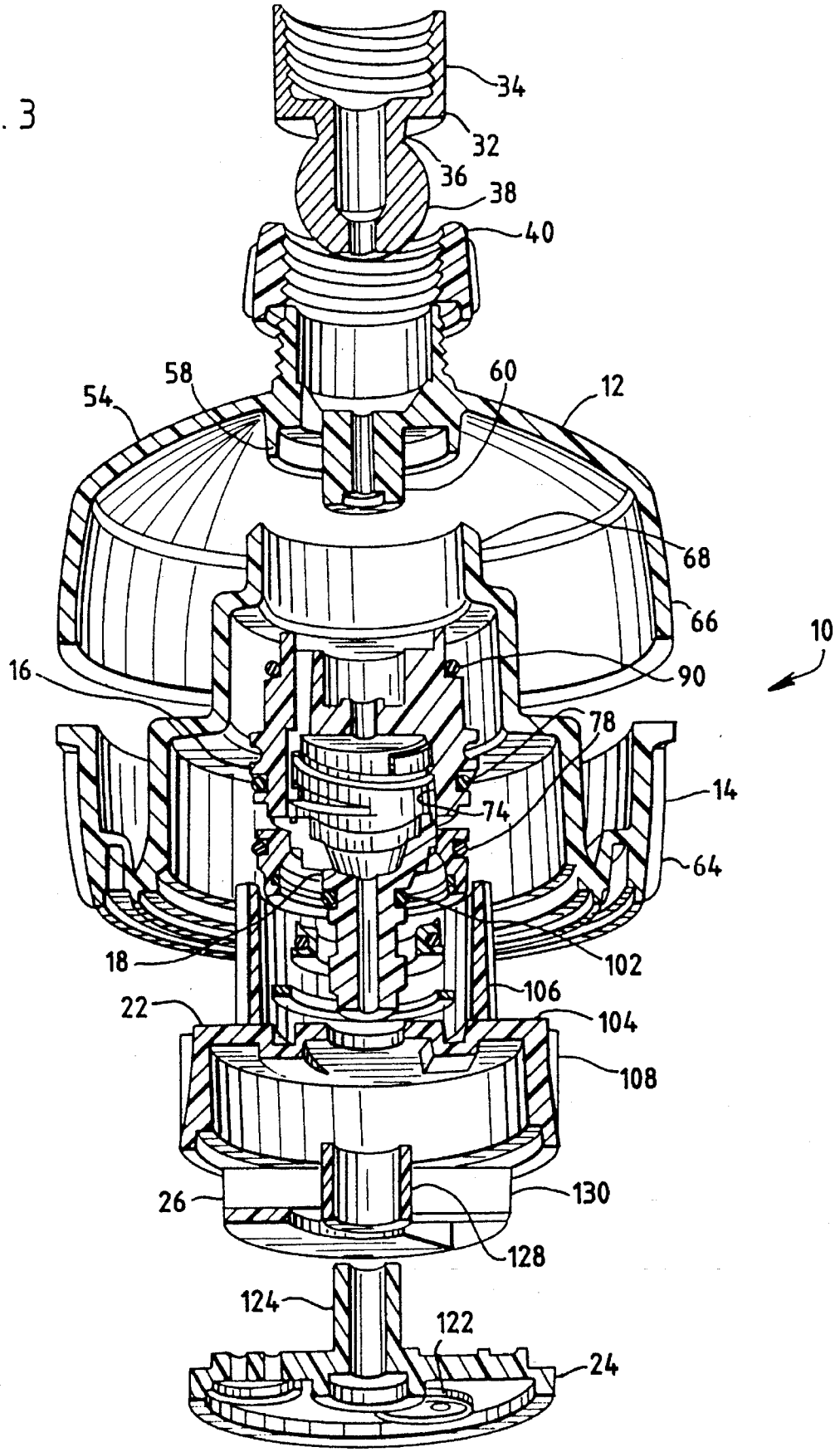
FIG. 3 is an exploded, slightly reduced, partially fragmentary, perspective view of the shower head of FIGS. 1 and 2.
Figure 4:
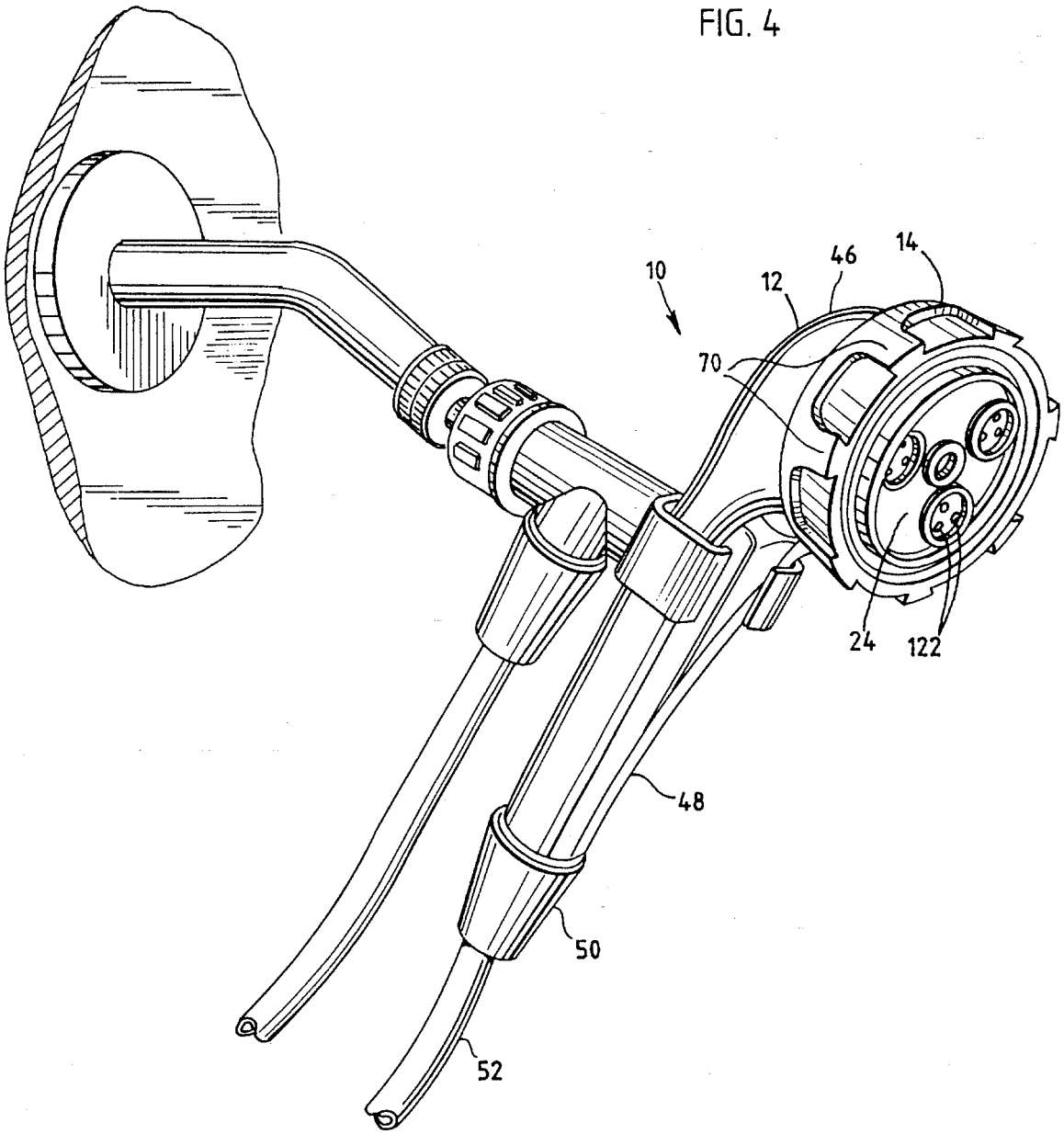
FIG. 4 is a perspective view of one form of the shower head adapted to be connected to the end of a flexible hose for hand-held operation.

The shower head 10 may be used as either a wall mounted unit as shown in FIGS. 1–3, or as a hand held unit as shown in FIG. 4. In the wall mounted unit embodiment, the upper body housing 12 is molded of plastic and is configured to accept a female-threaded coupling means at its upstream end for connecting to a water source, which is typically a male threaded pipe end (not shown). The coupling means includes a ball connector 32 that provides, integrally as one part, an upstream, female-threaded, coupling portion 34 adapted for connection to a male-threaded pipe end, a bored spacer neck 36, and a downstream, axially bored, pivot ball 38. A molded annular coupling nut 40, of greater inner diameter than pivot ball 38, is assembled onto the pivot ball 38, and held thereto by retainer ring 42. The molded annular coupling nut 40 is threaded onto the upper body housing 12. Seated between the upper body housing 12 and the pivot ball 38 there is provided a soft elastic watertight gasket 44. This gasket 44 must be soft enough yet elastic enough to provide sufficient friction with the pivot ball 38 so that the upper body housing 12 does not rotate when the lower body housing 14 is rotated by the user.

In the hand held unit embodiment (FIG. 4), the upper body housing 12 is molded of plastic to provide a downstream cup-shaped end 46 and an upstream tubular-shaped connector end 48. The connector end 48 is provided with a male threaded fitting (not shown) that cooperates with a female fitting 50. The female fitting 50, in turn, is connected to the end of a flexible water supply hose 52.

The upper body housing 12 comprises a cup-shaped outer wall 54 having a radially inwardly extending rib 56 (FIG. 2). The rib 56 limits the rotation of the lower body housing 14 to about 360 degrees, as described more fully below. The upper body housing 12 also comprises a downstream extending substantially cylindrical inner wall 58 and an axially-bored center stem 60 provided with axially extending thread means 62 therein. These elements on the upper body housing 12 are specifically constructed and arranged to receive and engage portions of the shower head parts that will now be described.

The lower body housing 14 is also formed of plastic and comprises an outer wall 64 of approximately the same circumference as the upper body housing outer wall 54, and a three-tiered inner wall 66 for receiving the stem housing 16, stem 18 and rotor housing 22. The three-tiered inner wall 66 includes a cylindrical upstream section 68 of such a diameter as to fit over the downstream extending cylindrical wall 58 of the upper body housing 12. Preferably, the lower body housing outer wall 64 is provided with ribs 70 (FIG. 4) for easy gripping by the user. A rib 72 interposed between the lower body housing outer wall 64 and the three-tiered inner wall 66 (FIG. 2) acts in conjunction with the upper body housing rib 56 to limit the movement of the lower body housing within an approximately 360 degree sweep. As will be explained below, this 360 degree adjustment allows for pulse spray, continuous spray, or a combination of pulse and continuous spray.

The upper and middle tiers of the lower body housing three-tiered inner wall 66 are configured to receive the stem housing 16. The lower body housing 14 can be rotated, but does not move axially.

Figure 5:
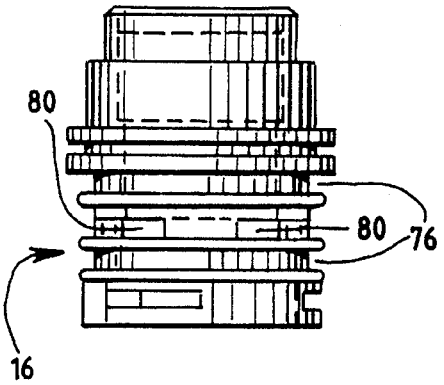
FIG. 5 is a slightly reduced side view of the stem housing of the pulsating shower head of FIG. 1.

The stem housing 16 fits within the upper and middle sections of the three-tiered inner wall 66 of the lower body housing 14 and is affixed to the upper body housing center stem 60 by screw 63 or other means. The stem housing 16 is generally cylindrical in shape and has internal threads 74 (FIG. 1) for receiving the hollow stem 18. The stem housing 16 has two circumferentially outwardly facing grooves 76 (FIG. 5) for holding O-rings 78. The O-rings 78 provide a sliding watertight seal between the stem housing 16 and the rotor housing 22.

A plurality of apertures 80 interposed between the two grooves 76 in the stem housing 16 direct water flow in the continuous spray mode, as shown in FIG. 1. The apertures 80 communicate with and direct water into an annular space 82 between the stem housing 16 and the lower body housing 14. As will be described more fully below, water entering this annular space is then directed to continuous spray chambers 84 and through a set of continuous spray jet apertures 86.

Figure 7:
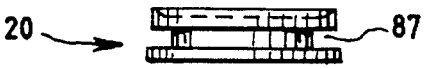
FIG. 7 is a slightly reduced side view of the O-ring retainer of the pulsating shower head of FIG. 1.

The stem housing 16 also has means for retaining the O-ring retainer 20 near its downstream end. The O-ring retainer 20 (FIG. 7) has a groove 87 therein for holding an O-ring 88. The O-ring 88 forms a watertight seal between the O-ring retainer 20 and the stem housing 16. The O-ring retainer 20 does not move relative to the stem housing 16. The stem 18 moves relative to the O-ring retainer 20 to either open or close an annular water channel leading to the rotor chamber 112, as described more fully below.

As already noted, the stem housing 16 is affixed to the upper body housing 12 so that the stem housing 16 remains stationary when the lower body housing 14 is rotated. A small O-ring 90 seated between the stem housing 16 and the lower body housing 14 provides a watertight seal between the two.

Figure 6A:
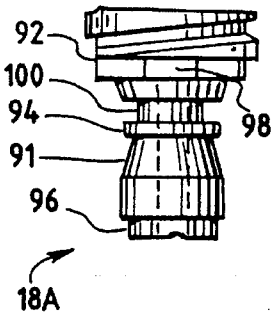
FIG. 6A is a slightly reduced side view of the stem of the pulsating shower head of FIGS. 1 and 2.

As best shown in FIG. 6A, in the preferred embodiment the stem 18 has a threaded upstream section 92, a middle section 94, and a downstream section 96. The stem 18 is threadably connected at its upstream section 92 to the stem housing 16 such that the stem 18 can move axially with respect to the stem housing 16. The stem 18 has a plurality of apertures 98 about its upstream section 92 for directing water flow in either the continuous spray or pulse spray modes.

The stem 18 also has a circumferentially outwardly facing groove 100 disposed about its middle section 94 for holding an O-ring 102. This O-ring 102 provides a watertight seal between the stem 18 and the O-ring retainer 20 in the continuous spray mode, as shown in FIG. 1. In the pulse spray mode, this seal is broken, allowing water to flow into the pulse chamber, as shown in FIG. 2. The lower section 96 of the stem is configured to receive in mating engagement the rotor housing 22 such that the stem 18 and rotor housing 22 move together, both rotationally and axially.

As shown in FIG. 6A, in the preferred embodiment, the middle section 94 of the stem 18 comprises a truncated conical portion 91. As explained below, this truncated conical portion 91 allows for a continuously variable pulse spray.

Figure 6B:
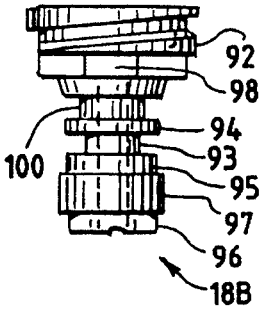
FIG. 6B is a side view of an alternative embodiment the stem of the pulsating shower head of FIGS. 1 and 2.

In an alternative embodiment shown in FIG. 6B, the middle section 94 of the stem comprises three cylindrical portions of varying diameters: a small diameter portion 93, a medium diameter portion 95 and a large diameter portion 97. As explained below, this alternative design allows for a variable pulse spray in three discrete pulse frequencies.

Figure 9:
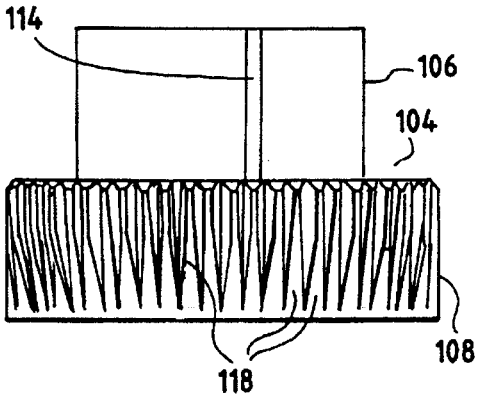
FIG. 9 is a slightly reduced side view of the rotor housing of the pulsating shower head of FIG. 1.

The rotor housing 22 has a transverse wall 104 and an upstream section 106 and a downstream section 108 extending therefrom (FIG. 9). The rotor housing 22 has a plurality of tangentially directed flow channels 110 (FIG. 2) disposed in the transverse wall 104 which direct jets of water downstream into a rotor chamber 112 to impinge on and rotate the rotor 26. The rotor housing 22 is affixed to the lower body housing 14 via the cooperation of grooves 114 in the rotor housing (one of which can be seen in FIG. 9) and positioning ribs 116 (FIGS. 1 and 2) extending inwardly from the lower body housing 14 such that the rotor housing 22 is axially, but not rotatably, translatable with respect to the lower body housing 14.

Generally V-shaped grooves 118 formed on the outside wall of the downstream section 106 of the rotor housing 22 cooperate with the spray seal 28 to form the continuous spray apertures 86 that provide for a variable continuous spray when the shower head 10 is in the continuous spray mode.

The pulse plate 24 has a transverse wall 120 with a set of pulse spray apertures 122 therethrough and a substantially cylindrical wall 124 extending upstream from the transverse wall 120. The cylindrical wall 124 abuts the lower section 96 of the stem 18. A large diameter O-ring 126 is interposed between the pulse plate transverse wall 120 and the rotor housing downstream section 108. The transverse and cylindrical walls of the pulse plate 24 and the downstream section 108 and transverse wall 104 of the rotor housing 22 define the annular rotor chamber 112.

The rotor 26 is rotatably mounted in the rotor chamber 112 about the pulse plate cylindrical wall 124 by a sleeve-type center hub 128. The inner bore of the center hub 128 is of such a size as to provide for sliding and rotation of the rotor 26 about the pulse plate cylindrical wall 124.

Figure 8:
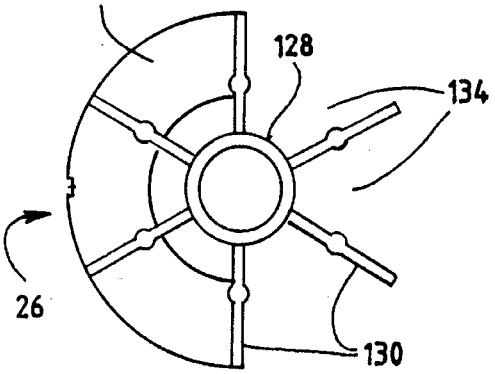
FIG. 8 is a slightly reduced top view of the rotor of the pulsating shower head of FIG. 1.

In the preferred embodiment, the rotor 26 has six circumferentially spaced vanes 130 (FIG. 8) extending radially from the center hub 128, and arcuate-shaped webs 132 bridging the space between four of the vanes 130, but leaving three adjacent flow-through channels.

The invention is used in the following manner. The lower body housing 14 is rotated within about a 360 degree sweep to provide the user with a variable pulse spray, a variable continuous spray, or combination pulse and continuous spray. Rotation of the lower body housing 14 causes the stem 18 and rotor housing 22 to move axially with respect to the stem housing 16, which remains stationary. This relative movement between the stem 18 and the stem housing 16 either opens or closes water channels communicating with the pulse and continuous spray chambers.

As shown in FIG. 1, when the lower body housing 14 is rotated into the continuous spray position, the stem 18 is moved axially in a downstream direction. The stem O-ring 102 forms a seal against the O-ring retainer 20, preventing water flow to the rotor chamber 112. The rotor housing 22 also moves axially in a downstream direction, disengaging the upstream O-ring 78 and opening a channel between the stem housing 16 and the lower body housing 14. The flow of water (designated by arrows) is directed through the stem apertures 98, through the stem housing apertures 80, into the continuous spray chamber 84, and through the continuous spray apertures 86, thus providing for a continuous spray.

As shown in FIG. 2, when the lower body housing 14 is rotated into the pulse spray position, the stem 18 moves in an upstream direction, causing the stem O-ring 102 to disengage from the O-ring retainer 20, allowing water to flow into the rotor chamber 112. At the same time, a seal is formed between the two circumferentially displaced O-rings 78 on the stem housing 16 and the interior wall of the rotor housing 22, thus sealing off the water channels to the continuous spray chamber 84. The flow of water (designated by arrows) is directed through the stem apertures 98, through the space between the stem 18 and the stem housing 16, through the tangentially directed flow channels 110 in the rotor housing 22, and into the rotor chamber 112. Jets of water impinge on the rotor vanes 130 causing the same to rotate rapidly with a minimum of friction. Since the webs 132 and through channels 134 of the rotor 26 alternately pass above each set of pulse spray apertures 122, there is produced a pulsating discharge through the apertures that will be projected from the shower head 10.

In the preferred embodiment shown in FIG. 2, the frequency of the pulses may be varied over a continuous range by rotating the lower body housing 14. When the lower body housing 14 is rotated to the pulse position, the area between the truncated conical portion 91 of the stem 18 and the O-ring retainer 20 is greatest, and the flow of water into the pulse chamber 112 is greatest, resulting in a fast pulse. As the lower body housing 14 is rotated further, the stem 18 moves upward and the flow is restricted by the lower edge of the O-ring retainer 20 and the truncated conical portion 91 of the stem 18, resulting in a slow pulse.

An alternative embodiment of the stem 18, shown in FIG. 6B, allows for the frequency of the pulse to be varied over three discrete settings. Rotating the lower body housing 14 causes the area between the stem 18 and the O-ring retainer 20 to vary among one of three cross-sectional areas. When the area is defined by the small diameter portion 93 of the stem 18 and the O-ring retainer 20, the gap is relatively large, the flow of water into the pulse chamber 112 is at its greatest, and the pulse frequency is relatively fast.

When the area is defined by the large diameter portion 97 of the stem 18 and the O-ring retainer 20, the area is relatively small, the flow of water into the pulse chamber 112 is at its smallest, and the pulse frequency is relatively slow. When the area is defined by the medium diameter portion 95 of the stem 18 and the O-ring retainer 20, the area is moderate in size, and the flow of water into the pulse chamber 112 is moderate, as is the pulse frequency.

Adjusting the lower body housing 14 to a setting intermediate between the pulse and continuous spray settings opens the water channels leading to both the continuous spray and pulse (i.e. rotor) chambers, resulting in a combination spray.

While particular embodiments of this invention have been shown and described, it will be obvious to those skilled in the art that various changes and modifications may be made therein without departing from the scope and spirit of the invention, and, therefore, it is intended in the appended claims to cover all such changes and modifications which fall within the true scope and spirit of the invention.

We claim as our invention:

1. A pulsating shower head comprising:

an upper body housing having a cup-shaped outer wall, a downstream-extending inner wall and a center stem;

a lower body housing having an outer wall abutting the upper body housing outer wall and a multi-tiered inner wall, said multi-tiered inner wall having an upstream section;

a stem housing configured to fit within the upstream section and affixed to the upper body housing center stem and having an upstream end and a downstream end, said stem housing being generally cylindrical in shape and having near its upstream end threads disposed on the inside of the stem housing for receiving a hollow stem, said stem housing having two circumferentially outwardly facing grooves for holding O-rings, said O-rings providing a sliding watertight seal between the stem housing and a rotor housing, a plurality of apertures interposed between the two grooves for directing water flow, and means for retaining an O-ring retainer near the stem housing downstream end;

the hollow stem having a threaded upstream section, a middle section, and a downstream section, the hollow stem being threadably connected at the hollow stem upstream section to the stem housing, the hollow stem having a plurality of apertures for directing water flow near the hollow stem upstream section and a circumferentially outwardly facing groove disposed about its middle section for holding an O-ring, said middle section O-ring providing a sliding watertight seal between the hollow stem and said O-ring retainer;

the rotor housing held in fixed relation to the hollow stem and having a transverse wall and upstream and downstream sections extending therefrom, the rotor housing having a plurality of tangentially directed flow channels disposed in the transverse wall which direct jets of water downstream thereof into a rotor chamber at a rotor driving velocity, the rotor housing being axially translatable with respect to the stem housing;

a pulse plate having a transverse wall with a set of pulse spray apertures therethrough and a substantially cylindrical wall extending upstream from the transverse wall, said cylindrical wall abutting the stem downstream section, said pulse plate transverse wall abutting the rotor housing downstream section, said pulse plate transverse and cylindrical walls defining said rotor chamber;

a rotor rotatably mounted in said rotor chamber;

a spray seal retainer affixed to the lower body housing; and a spray seal interposed between the spray seal retainer and lower body housing, the spray seal and the rotor housing downstream section defining a set of continuous spray apertures;

wherein rotation of the lower body housing causes the stem to translate axially on the threaded inner wall of the stem housing, causing the selective discharge of either a pulsed spray through the pulse spray apertures, or a continuous spray through the continuous spray apertures, or a combination of both pulse spray and jet spray.

2. The pulsating shower head of claim 1 wherein rotation of the lower body housing to a pulse position causes the rotor housing and the hollow stem to translate axially relative to the stem housing, closing off a water channel to a continuous spray chamber by causing the stem housing O-rings to form watertight seals with the rotor housing, and opening a water channel to the rotor chamber by causing the hollow stem O-ring to disengage from the O-ring retainer.

3. The pulsating shower head of claim 1 wherein the rotor further comprises six equally circumferentially spaced vanes extending radially from a sleeve-type center hub, and arcuate shaped webs bridging the space included between four of the vanes.

4. The pulsating shower head of claim 1 wherein the hollow rotor housing further comprises a plurality generally V-shaped grooves formed on an outside wall of the rotor housing downstream section, said generally V-shaped grooves cooperating with the spray seal to form continuous spray apertures.

5. The pulsating shower head of claim 1 wherein the hollow stem middle section comprises a truncated conical portion, wherein rotation of the lower body housing varies the frequency of the pulsed spray over a continuously variable range.

6. The pulsating shower head of claim 1 wherein the hollow stem middle section comprises a plurality of cylindrical portions of varying diameters such that rotation of the lower body housing varies the frequency of the pulsed spray over discrete settings.

7. The pulsating shower head of claim 1 wherein the hollow stem middle section comprises a small diameter portion, a medium diameter portion and a large diameter portion, wherein rotation of the lower body housing varies the frequency of the pulsed spray over three discrete settings.

* * * * *

UNITED STATES PATENT AND TRADEMARK OFFICE

CERTIFICATE OF CORRECTION

PATENT NO. : 5,518,181

DATED : May 21, 1996

INVENTOR(S) : Sidney J. Shames and Harold Shames

It is certified that error appears in the above-identified patent and that said Letters Patent is hereby corrected as shown below:

Column 8, line 44, delete "hollow" from the phrase "wherein the hollow rotor housing"

Signed and Sealed this

Sixth Day of August, 1996

Bruce Lehman

*Attest:*

BRUCE LEHMAN

*Attesting Officer*

*Commissioner of Patents and Trademarks*